United States Patent [19]

Rebhan

[11] 4,022,060

[45] May 10, 1977

[54] INFANTS' FEEDING BOTTLE

[76] Inventor: Horst Rebhan, P.O. Box 10, D-8641 Stockheim, Germany

[22] Filed: Oct. 2, 1975

[21] Appl. No.: 619,069

Related U.S. Application Data

[63] Continuation-in-part of Ser. No. 413,590, Nov. 7, 1973, abandoned.

[52] U.S. Cl. ..... 73/343 B; 215/11 A

[51] Int. Cl.² ..... A61J 9/02

[58] Field of Search ..... 215/11 A; 73/343 B, 73/374

[56] References Cited

UNITED STATES PATENTS

| | | | |
|---|---|---|---|
| 2,313,688 | 3/1943 | Wappner | 73/374 |
| 2,472,996 | 6/1949 | Wilder | 73/374 |
| 2,505,037 | 4/1950 | Frumkin | 73/343 B |
| 2,591,375 | 4/1952 | Radford | 73/374 X |

FOREIGN PATENTS OR APPLICATIONS

| | | | |
|---|---|---|---|
| 529,102 | 6/1954 | Belgium | 73/374 |
| 954,915 | 6/1949 | France | 215/11 A |
| 608,516 | 9/1960 | Italy | 73/343 B |

*Primary Examiner*—Donald F. Norton
*Attorney, Agent, or Firm*—Wolf, Greenfield & Sacks

[57] ABSTRACT

An infants' feeding bottle provided with an indicating device such as a thermometer or graduated scale is detachably carried on the wall of the bottle. The indicating device includes a sheath which is received in an elongate slot formed in the bottle wall, the slot being exposed only at the exterior of the bottle and having no communication with the interior of the bottle. The lower end of the slot terminates above the bottom wall of the bottle and the upper end of the slot is open at the tapered neck region of the wall to permit insertion or withdrawal of the sheath from the neck end of the bottle.

12 Claims, 10 Drawing Figures

FIG. 7
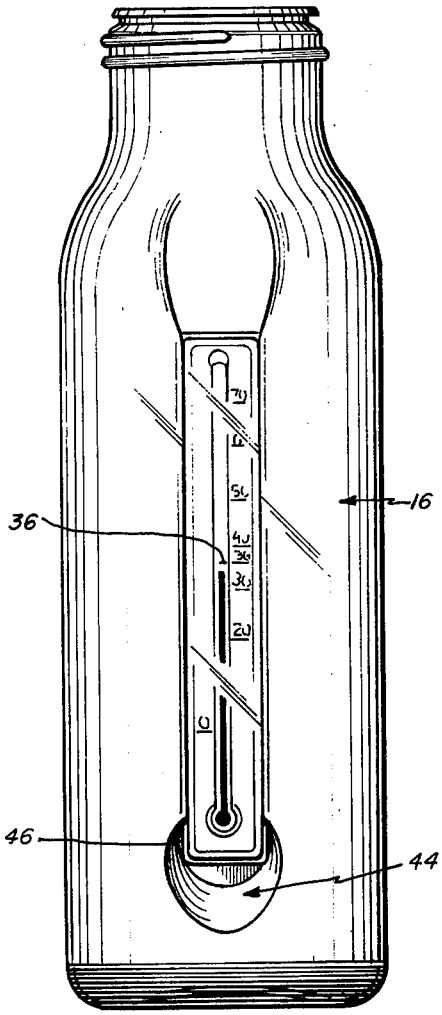
FIG. 8
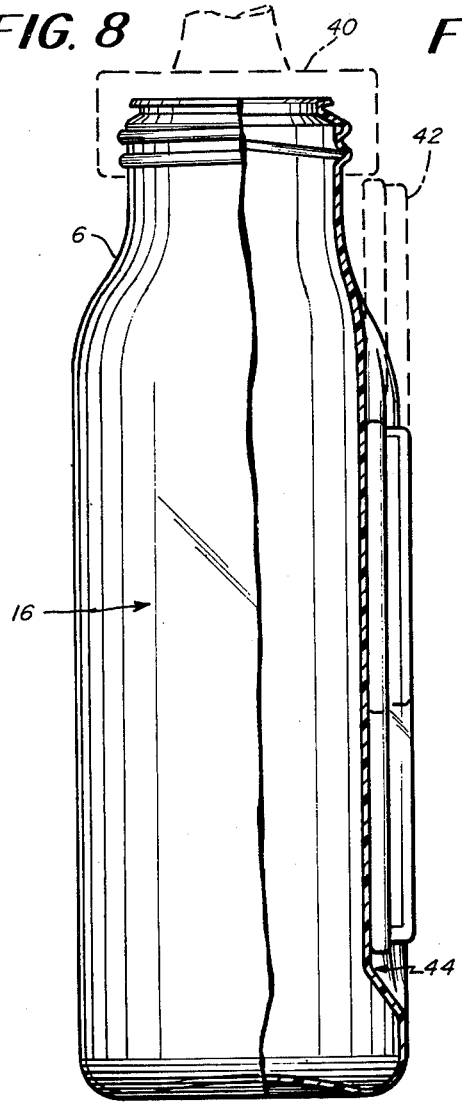
FIG. 4
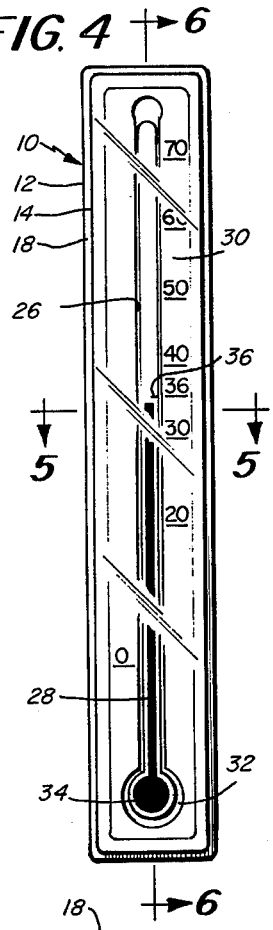
FIG. 6
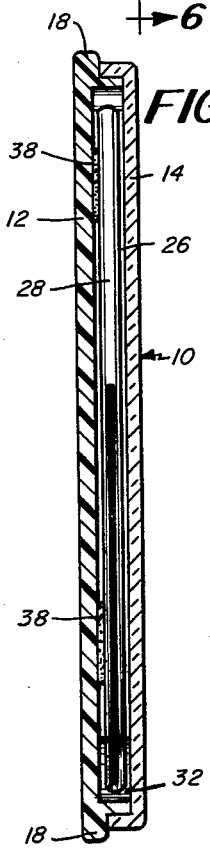
FIG. 9
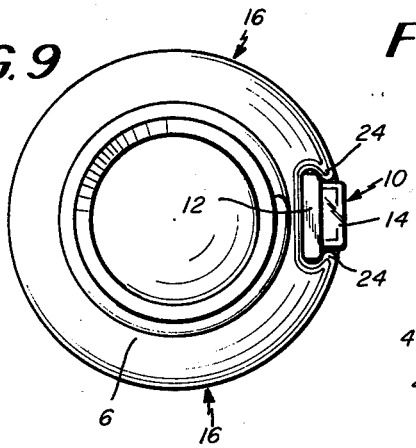
FIG. 5
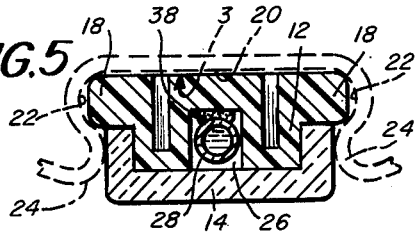
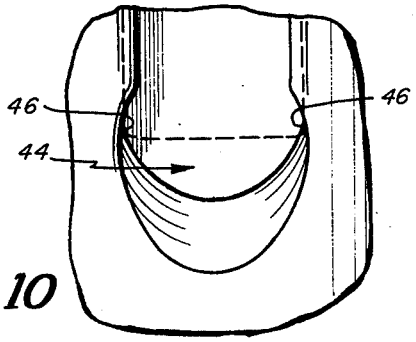
FIG. 10

INFANTS' FEEDING BOTTLE

RELATED APPLICATION

This application is a continuation-in-part of my copending application Ser. No. 413,590, filed Nov. 7, 1973, now abandoned.

BACKGROUND OF THE INVENTION

This invention relates to infant's feeding bottles an particularly to infant's feeding bottles which are provided with an indicating device such as a thermometer and/or a graduated scale for indicating the weight or volume of the contents of the bottle. Feeding bottles having indicator devices located exteriorly of the bottle are known to have the advantage of isolating the device from the interior of the bottle and, therefore, from the bottle contents. For example, if the exteriorly located indicating device breaks, its splinters or other parts will not enter the bottle and become mixed with the milk or other contents intended for the infant's consumption. Typically, in the prior feeding bottles of this type, the indicating device is adhesively bonded, or fused to the outer surface of the bottle or is otherwise formed integrally with the bottle. The bottle may be formed to define an external slot along the outer surface of the bottle which can receive and hopefully protect the indicating device from damage as well as to permanently hold it in place so that it cannot be lost or mislaid.

The prior devices are not free from difficulty. For example, where the indicator device is in the form of a thermometer or a graduated scale for indicating the weight or volume of the bottle contents, these devices typically are fragile and are sensitive to shock and high temperatures because they are made ordinarily from glass. Even with those prior devices in which the indicating device is permanently integrated with the bottle to provide some degree of resistance to impact and shock, their inability to be detached from the bottle presents problems when the bottle must be sterilized at high temperatures, for example, by boiling. In particular, the thermometer is not usually capable of withstanding the high temperatures of sterilization and could break or, if it does not break could later tend to give unreliable readings. In addition, the prior devices have not lent themselves well to inexpensive manufacturing techniques. It is among the primary objects of the invention to provide an improved infant's feeding bottle of the general type described which overcomes the above and other difficulties.

SUMMARY OF THE INVENTION

The invention may be embodied in an infant's feeding bottle having a longitudinal slot formed along its wall and exposed only exteriorly on the wall so that the slot has no communication with and is entirely isolated from the interior of the bottle. The sidewalls which define the slot are formed so that the maximum width of the slot is at its innermost region, with the slot narrowing in cross-sectional configuration as it approaches its more outwardly disposed region. The lower end of the slot terminates above the bottom wall of the bottle and the upper end of the slot merges smoothly into the tapered neck portion of the bottle to enable the indicator assembly to be inserted into and/or removed longitudinally from the slot through the opening defined at the neck end of the bottle. The lower end of the slot also may be formed to define a depression in the bottle sidewall to enable one's thumb to engage the bottom end of the indicator assembly to urge it upwardly out of the slot. The bottle preferably is fabricated from a somewhat resilient material, such as plastic so that it can yield slightly and receive the indicator assembly in the slot in a tight, snug fit.

The indicator assembly includes a sheath which is slidably received in the slot in a snug, but removable fit. The indicator assembly includes an elongate sheath which contains the indicator device, such as the thermometer. The sheath includes an outwardly facing transparent panel through which the thermometer may be observed. A suitably graduated scale may be incorporated into the sheath for use in connection with the thermometer. The sheath is constructed to protect the indicator from damage and also permits its separation from the bottle when the bottle is to be sterilized. In a further aspect of the invention the removal of the indicator assembly is precluded by a screw-on cap for the bottle which interferes with the upper end of the sheath when the cap is in place.

It is among the objects of the invention to provide an improved infants' feeding bottle having a detachable indicator device.

A further object of the invention is to provide an infants' feeding bottle of the type described in which the indicating device is housed within a protective sheath which is held firmly to the exterior of the bottle yet which is easily removable when desired.

Another object of the invention is to provide an improved infants' feeding bottle of the type described which is rugged, durable and reliable yet which is inexpensive to produce.

A further object of the invention is to provide an infants' feeding bottle of the type described having a removable sheath which facilitates calibration of the indicating device with respect to the sheath.

Still another object of the invention is to provide an infants' feeding bottle of the type described having a removable indicator assembly which is incapable of being removed by an infant.

DESCRIPTION OF THE DRAWINGS

The foregoing and other objects and advantages of the invention will be understood more fully from the following further description thereof, with reference to the accompanying drawings wherein:

FIG. 4 is a front elevation of a modified form of sheath;

FIG. 5 is a sectional illustration of the sheath as seen along the line 5—5 of FIG. 4;

FIG. 6 is a sectional illustration of the sheath seen along the line 6—6 of FIG. 4;

FIG. 7 is an illustration of a modified bottle having a thumb slot formed at the lower region of the sheath slot;

FIG. 8 is a side elevation, partly in section, of the embodiment shown in FIG. 7; and FIG. 9 is a plan view of the embodiment shown in FIG. 7.

FIG. 10 is an enlarged view of the thumb slot shown in FIG. 7.

DESCRIPTION OF THE PREFERRED EMBODIMENTS

Figure 1:
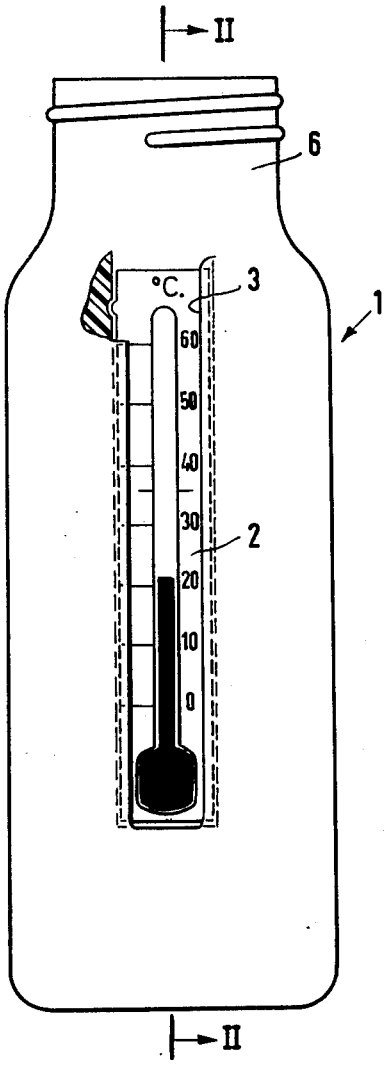
FIG. 1 is a front elevation of a preferred embodiment of an infants' feeding bottle in accordance with the invention.
Figure 2:
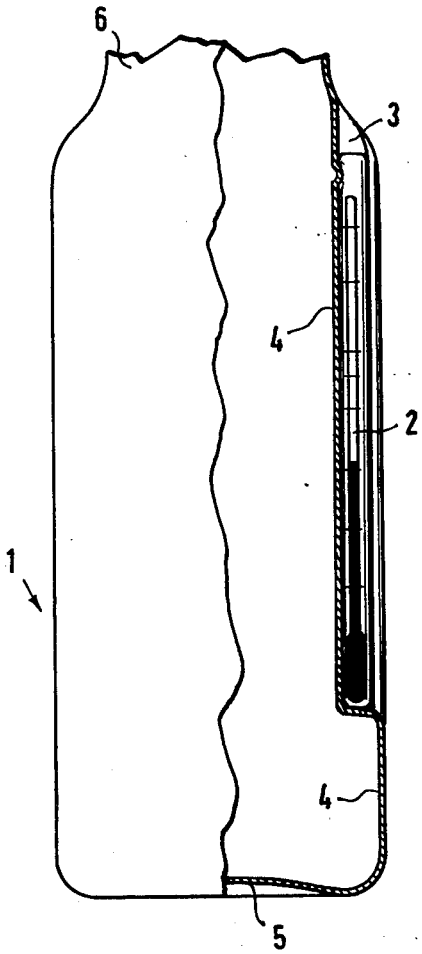
FIG. 2 is a partly sectional side elevation of the bottle shown in FIG. 1 and seen along the line 2—2.
Figure 3:
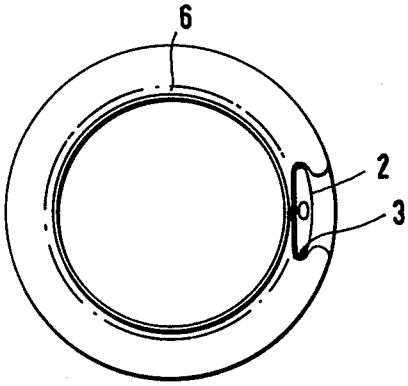
FIG. 3 is a plan view of the bottle shown in FIG. 1.

FIGS. 1 through 3 show a feeding bottle 1 having an indicator assembly 2 (illustrated as including a thermometer). The indicator assembly is retained with a slot 3 or guideway formed in the wall of the feeding bottle 1. The slot 3 extends longitudinally along the bottle wall 4, substantially parallel to the axis of the bottle. The lower end of the slot terminates some distance above the bottom 5 of the bottle. The slot 3 is of substantially continuous cross-section along its length and its upper end merges smoothly into the tapered neck 6 to define an opening through which the indicator assembly may be inserted or removed.

The bottle 1 preferably is of molded plastic construction and is somewhat flexible and resilient so that it will be relatively unbreakable even when handled roughly and also so that it can receive the indicator assembly in the desired snug, tight fit as will be described.

The slot 3 is formed to define a pair of sidewalls which tend to converge as they approach the outer circumferential region of the bottle wall so that the width of the slot 3 at its base is greater than its width at its more outwardly disposed regions. The slot 3 thus may be considered as having a pair of elongate lips extending longitudinally along the sides of the slot 3. The configuration and shape of the indicator assembly is such that it will be firmly engaged and held in the slot 3.

FIGS. 4–6 show a modified embodiment of the indicator assembly which includes a sheath 10 having a base portion 12 and a cover 14, both of which can be made from plastic which is more rigid than that from which the bottle 16 itself is made. The base portion 12 of the sheath 10 includes an elongate peripheral flange 18 extending about the base portion. The base 12 and flange 18 are dimensioned to be received within the slot 3 and to engage the bottom 20, sidewalls 22 and lips 24 of the slot in a snug, firm fit. The resilience of the bottle permits the slotdefining portions to yield slightly to receive the flange and base. The base portion 12 of the sheath 10 has also a longitudinal slot 26 formed in front, outwardly facing side to receive the indicating device, such as a thermometer 28. The thermometer 28 is enclosed and sealed within the sheath by the sheath cover 14 which fits over the base 12 and is secured to the base 12 by adhesive or the like. The cover 14 is transparent to permit observation of the thermometer 28. The base 12 preferably is provided with an appropriate scale 30 which also can be observed through the transparent cover 14. The resulting indicator assembly thus includes a relatively rigid sheath which houses and protects the relatively delicate thermometer 28 from damage yet which is sufficiently rigid to cause the surfaces of the slot 3 to yield when the sheath 10 is inserted, to firmly retain the sheath 10 in the slot 3.

The construction of the sheath 10 also facilitates initial assembly of the thermometer 28 with respect to the temperature scale 30 to insure that the device will be calibrated properly. To this end, the slot 26 formed in the base 12 of the sheath 10 has an enlarged opening 32 at the lower end which receives the bulb 34 of the thermometer 28. The overall length of the slot 26 thus is more than the length of the thermometer 28. The enlarged opening 32 enables the thermometer 28 to be shifted somewhat longitudinally in the slot 26 with respect to the scale 30. Typically, the thermometer tube itself will have been marked as suggested at 36 in FIGS. 4 and 7 which indicates a known temperature. The thermometer 28 is placed in the slot 26 with the calibration mark 36 in alignment with the proper scale reading and the thermometer then may be secured in that position by a drop of adhesive 38. With a thermometer 28 properly located in the slot 26, the transparent sheath cover 14 is secured to the base 12 to enclose and seal the thermometer.

The sheath 10 thus provides a strong, rigid enclosure for the thermometer and also seals the thermometer so that in the unlikely event that the thermometer does break from a severe shock or impact the thermometer parts and fluid will remain encapsulated in the sheath where they cannot injure the infant.

The firm friction fit between the sheath 10 and the slot 3 is sufficient to hold these parts together and preclude inadvertent separation. Should it be desired to provide additional means for retaining the sheath 10 and bottle 1 together, and to prevent the sheath from sliding upwardly out of the slot, elevations or indentations may be formed at one or more locations along the length of the slot 3 or sheath 10 which can engage each other in a snap-like action. This may be desirable in an embodiment in which the bottle is relatively inelastic and in which the sheath is more resilient and elastic than the material from which the bottle is made, for example, glass. In such an embodiment, the sheath may be made at least in part from an elastically resilient plastic.

In addition to the firm friction fit between the sheath 10 and the bottle and/or the snap-fit indentations and projections of the sheath and bottle, the indicator assembly is further precluded from the separation from the bottle when the screw cap (shown in phantom at 40 in FIG. 8) is screwed into place over the neck 6 of the bottle. The slot 3 which terminates at its upper end alongside the neck holds the indicator assembly so that its upper end will engage the screw cap 40 before it has been fully withdrawn as suggested in phantom at 42 in FIG. 8. This presents an additional safety feature in that by requiring removal of the cap the chances of the infant removing the sheath are reduced.

In the embodiment of FIG. 1, when the sheath is fully inserted into the slot 3 the bottom of the sheath abuts the bottom end of the slot 3 which determines the fully inserted position of the sheath and also insures that the sheath will not slip out of the slot in a downward direction.

FIG. 7 illustrates a modification of the lower end of the slot 3 to facilitate removal of the sheath 10. Here, the sidewall 16 of the bottle is provided with an identation 44 which merges smoothly from the inner wall 20 of the slot 3 outwardly and downwardly toward the lower regions of the sidewall 16. The indentation provides a smooth, somewhat enlarged area into which one's thumb may be placed to engage the bottom end of the sheath 10 to urge it upwardly out of the slot 3. The sheath 10 cannot be urged into the thumb indentation because the corners 46 of the flange 18 at the lower end of the sheath 10 engage the sloped thumb indentation near the upper end of the indentation 44 as shown in FIG. 7.

The graduations may be calibrated with a volume or weight scale and may be formed on the indicator device itself or in the walls of the bottle, in the inner wall 20 of the slot 3 or alongside the slot on the external surface of the bottle. Alternatively, a scale indicating volume or weight units may be formed on a strip which can be interposed between the removable indicator device and the inner wall 20 of the slot. In this regard, the bottle 1 may be transparent to enable the volume or weight unit indicating scale to be seen through the opposite side of the bottle.

Thus, the invention provides numerous advantages over prior infants' feeding bottles. The typically delicate indicator device can be removed for sterilization of the bottle, yet can by very securely attached to the bottle at all other times. Moreover, snce it is only desirable to remove the indicator when the bottle is to be sterilized there is little opportunity for the indicator device to become lost or mislaid. The sheath's construction also protects the thermometer from external shocks at least as well, if not better than if the indicator was permanently fixed to the bottle wall. And in the unlikely event that the indicator became damaged the splintered parts and liquid would remain encapsulted. Also, it would not be necessary to replace the entire bottle because the indicator itself could be replaced.

It should be understood that the foregoing description of the invention is intended merely to be illustrative thereof and that other indications and embodiments may be apparent to those skilled in the art without departing from its spirit.

Having thus described the invention, what I desire to claim and secure by Letters Patent is:

1. In an infants' feeding bottle having a bottom wall, an outside wall and an upwardly tapering neck portion and having a longitudinal slot defined along the outside wall of the bottle, the slot having no communication with the bottle interior, the maximum width of the slot exceeding the width of the slot opening in the external bottle wall surface, the improvement comprising, in combination:

the lower end of the slot terminating above the level of the bottom wall of the bottle and the upper end of the slot extending above the level of the juncture of the bottle wall and the tapered neck portion and merging into the tapered neck portion;

an elongate sheath having a transparent portion, the sheath being removably received within and in frictional engagement with the slot; and an indicating device contained within the sheath.

2. A feeding bottle as defined in claim 1 further comprising:

the slot being formed to define a projection at one or more locations for snap-fit cooperation engagement with an indentation in the sheath.

3. A feeding bottle as defined in claim 1 further comprising:

the slot being formed to define an indentation at one or more locations for snap-fit cooperation with a projection formed on the sheath.

4. In an infants' feeding bottle having a bottom wall, an outside wall and a neck portion which tapers upwardly from the upper end of the outside wall, the bottle having a longitudinal slot formed along its outside wall, the slot having its maximum cross-sectional width at a location inwardly of the longitudinal opening of the slot, the improvement comprising, in combination:

the lower end of the slot terminating above the level of the bottom wall, the upper end of the slot extending above the level of the juncture of the outside wall and the tapered neck portion and merging into the tapered neck portion;

an indicator device dimensioned to be removably received only through the open, upper end of the slot; and a cap engaged with the neck portion of the bottle to cover the upper end of the bottle, the cap being constructed to obstruct the upper end of the slot to preclude removal of the indicating device at least when the cap is attached.

5. A feeding bottle as defined in claim 4 further comprising:

the indicating device including a transparent sheath receivable in the slot, the sheath being frictionally engageable with the slot.

6. An infants' feeding bottle as defined in claim 4 further comprising:

the upper end of the neck portion being externally threaded to receive a threaded cap thereon;

elongate transparent sheath dimensioned to be removably received only through the open, upper end of the slot;

said indicating device being enclosed within the sheath; and the slot being disposed with respect to the threaded neck portion so as to obstruct removal of the sheath when the cap is attached.

7. A feeding bottle as defined in claim 6 further comprising:

the sheath being frictionally engageable with the slot.

8. An infants' feeding bottle comprising:

a bottom wall and a sidewall extending upwardly from the bottom wall, the sidewall being formed to define an elongate guideway extending longitudinally of the bottle, said guideway being open at one end, said guideway being of predetermined cross-sectional configuration;

an elongate sheath received in the guideway, said sheath having a transparent portion, the elongate sheath being of cross-sectional configuration to enable it to be inserted into the guideway through the open end thereof, the cross-sectional configuration of the sheath and guideway being such as to cause the sheath and guideway to engage in a snug, frictional fit, said sheath containing an indicating device therein which is observable through the transparent portion of the sheath; and at least one of the sheath or guideway portion of the bottle sidewall being of resilient, deformable construction to facilitate said frictional engagement therebetween.

9. An infants' feeding bottle as defined in claim 8 further comprising:

the bottle sidewall further being formed to define a depression in communication with the opposite end of the guideway to expose an end of the sheath and enable it to be pushed out of the guideway from said exposed end.

10. An infants' feeding bottle as defined in claim 8 further comprising:

said bottle being molded from a resilient, flexible material and said sheath being formed from a more rigid, relatively inflexible material; and a thermometer contained within the indicating device.

11. In an infants' feeding bottle formed from a resilient, flexible material and having an elongate guideway formed along the sidewall of the bottle to receive an elongate indicating device, an improved indicating device comprising:

a sheath having a base portion and a cover portion, the base portion having an elongate slot formed therein to receive a thermometer;

a thermometer in the slot;

at least said base portion being formed from a relatively rigid material and being dimensioned to be received in the guideway in a snug, frictional fit;

the cover being transparent to enable the thermometer to be observed therethrough.

12. In an infants' feeding bottle as defined in claim 11, said sheath and thermometer being further characterized by:

a temperature scale formed on the base portion and extending along the thermometer slot, the scale being exposed through the transparent cover;

said thermometer slot being longer than the thermometer to enable the thermometer to be placed initially in the slot in proper position with respect to the scale.

* * * * *